US005890938A

United States Patent [19]

Eick et al.

[11] Patent Number: 5,890,938

[45] Date of Patent: Apr. 6, 1999

[54] MARINE COUNTER-ROTATIONAL PROPULSION SYSTEM

[75] Inventors: Edward C. Eick, Stillwater, Okla.; Robert B. Weronke, Oshkosh, Wis.; Woody R. Smith, Stillwater, Okla.; Donald F. Harry, Appleton; Hubert S. Gilgenbach, Oshkosh, both of Wis.

[73] Assignee: Brunswick Corporation, Lake Forest, Ill.

[21] Appl. No.: 942,770

[22] Filed: Oct. 2, 1997

[51] Int. Cl.[6] ..... B63H 5/10

[52] U.S. Cl. ..... 440/80; 416/129

[58] Field of Search ..... 416/128, 129; 440/75, 80, 81

[56] References Cited

U.S. PATENT DOCUMENTS

| | | | |
|---|---|---|---|
| 2,196,706 | 4/1940 | Naginskas | 440/81 |
| 4,963,108 | 10/1990 | Koda et al. | 440/83 |
| 5,083,989 | 1/1992 | Yates et al. | 475/248 |
| 5,230,644 | 7/1993 | Meisenburg et al. | 440/80 |
| 5,249,995 | 10/1993 | Meisenburg et al. | 440/81 |
| 5,352,141 | 10/1994 | Shields et al. | 440/80 |
| 5,366,398 | 11/1994 | Meisenburg et al. | 440/81 |
| 5,601,464 | 2/1997 | Ogina et al. | 440/75 |

OTHER PUBLICATIONS

Quicksilver Parts Catalog, "Bravo I/II/III", Revised Aug. 1996.

*Primary Examiner*—Stephen Avila
*Attorney, Agent, or Firm*—William D. Lanyi

[57] ABSTRACT

A marine propulsion system with counter-rotating propellers is provided with the capability of causing the propellers to rotate at different speeds. A first gear is attached to an inner propeller shaft and a second gear is attached to an outer propeller shaft. The inner and outer propeller shafts are arranged in coaxial and concentric relation for rotation about an axis of rotation. A driveshaft is connected to a pinion gear which engages the teeth of the fore and aft gears at different effective diameters. The pinion gear meshes with a first plurality of gear teeth on a beveled surface of the fore gear while a second set of gear teeth of the pinion gear mesh with a second plurality of gear teeth on a beveled surface of the aft gear. Because of the different effective diameters of the first and second pluralities of gear teeth, the inner and outer shafts rotate at different speeds.

20 Claims, 4 Drawing Sheets

MARINE COUNTER-ROTATIONAL PROPULSION SYSTEM

BACKGROUND OF THE INVENTION

1. Field of the Invention

The present invention relates generally to marine propulsion systems with two propellers on two propeller shafts that rotate about a common axis in which the two propellers rotate in opposite directions and, more specifically, to a marine propulsion system that rotates one of the two propellers at a different rotational speed than the other.

2. Description of the Prior Art

Many different types of marine propulsion systems are well known to those skilled in the art. A certain type of marine propulsion system mounts two counter-rotating propellers inline to rotate about a common axis of rotation.

Marine propulsion systems of this kind can be used in stern drive applications, where the engine is enclosed within the hull of a boat and the propellers are mounted on a unit attached to the transom and driven by a driveshaft extending through the transom. Alternatively, an outboard motor can be provided with dual counter-rotating propellers. The present invention is equally applicable to either a stern drive system or an outboard motor system.

U.S. Pat. 5,352,141, which issued to Shields et al on Oct. 4, 1994, discloses a marine drive with dual propeller exhaust and lubrication system. The drive has a bearing and seal housing which is called a spool and which is positioned in the lower horizontal bore and supporting a dual propeller shaft assembly. An exhaust passage includes a passage in the drive housing communicating with the horizontal bore at the spool, and a spool exhaust passage passing exhaust rearwardly through the spool to the propeller through-hub exhaust passages, providing through-hub exhaust through dual propellers. An inner oil passage in the spool communicates with the horizontal bore forewardly of the exhaust passage and lubricates the dual propeller shaft assembly.

U.S. Pat. No. 5,083,989, which issued to Yates et al on Jan. 28, 1992, describes a drive transmission which is particularly suitable for ship propulsion. The transmission comprises nested, contra-rotating propeller shafts which, in one example, are driven by a single input shaft and which transmits contra-rotating drives to the shaft via respective planet carriers. Particular advantages are the equal divisions of torque between the shafts and the enabling of location of thrust bearings in positions which are easy to access.

U.S. Pat. No. 5,366,398, which issued to Meisenburg et al on Nov. 22, 1994, discloses a marine dual propeller lower bore drive assembly. The marine drive has two counter-rotating propellers. Inner and outer concentric counter-rotating propeller shafts are supported by a spool in the lower horizontal bore. Passages are provided in the housing for communicating lubrication and/or exhaust with the horizontal bore. A locking structure holds the driven gears and bearings in place in the lower horizontal bore.

U.S. Pat. No. 5,601,464, which issued to Ogino et al on Feb. 11, 1997, describes a transmission system for a counter-rotational propulsion device. The transmission system is easily incorporated into an existing outboard drive of a watercraft in order to convert the outboard drive from a single propeller drive to a counter-rotational dual propeller system. The transmission system involves a first transmission which selectively couples an inner propulsion shaft with an existing driveshaft of the outboard drive. The inner propulsion shaft in turn drives a rear propeller. A second transmission of the transmission system is provided between the inner propulsion shaft and a outer propulsion shaft. The second transmission reverses the rotational drive direction input by the inner propulsion shaft so as to drive the outer propulsion shaft in an opposite rotational direction. The outer propulsion shaft drives a front propeller which spins in an opposite direction to that of the rear propeller, but exerts a thrust in the same direction as the rear propeller.

U.S. Pat. No. 5,230,644, which issued to Meisenburg et al on Jul. 27, 1993, discloses a counter-rotating surfacing marine drive. The drive has two counter-rotating surface operating propellers. An upper adapter spool has a lower threaded outer portion mating with a threaded portion of the vertical bore of the drive housing and supporting the upper gear for rotation about the driveshaft and supporting the driveshaft for rotation within the adapter spool. A vertical bore structure enables assembly from above of the majority of the vertical train components into a one piece unitary integrally cast housing. The vertical distance between the adapter spool and the lower bearings supporting the vertical driveshaft is approximately equal to the propeller radius. The lower concentric counter-rotating propellers shafts are spaced from the upper input shaft by a distance along the driveshaft in the range of approximately 9 to 15 inches.

U.S. Pat. No. 4,963,108, which issued to Koda et al on Oct. 16, 1990, describes a marine counter-rotating propeller drive system. The system comprises a large gear driven by an engine, and a plurality of small gears disposed so as to respectively mesh with the large gear at a plurality of fixed positions along the circumference of the large gear. Planet gears are respectively mounted to the gear shafts of the small gears. A sun gear and an inner tooth gear are respectively meshed with the planet gears. A rear propeller is mounted to an inner shaft serving as a gear shaft of the sun gear. A front propeller is mounted to a tubular outer shaft serving as a gear shaft of the inner tooth gear. The system can eliminate, with a simple construction, the inconvenience caused by a differential planetary gear operation as known in the prior art and can derive a propeller efficiency to a maximum extent.

U.S. Pat. No. 5,249,995, which issued to Meisenburg et al on October 5, 1993, discloses a marine drive having two counter-rotating surfacing propellers and dual propeller shaft assemblies. The marine drive has two counter-rotating surface operating propellers. Inner and outer concentric counter-rotating propeller shafts are supported by a spool assembly locked and retained against rotation and against axial movement in the lower horizontal bore in the torpedo of the drive housing by axially spaced left and right hand threads. A thrust bearing assembly transfers thrust from the outer propeller shaft to the inner propeller shaft during rotation of the propeller shafts in an opposite direction and is located between the fore and aft driven gears. Propeller shaft sealing and bearing structure and propeller self centering mounting structures are also provided.

In certain applications of dual propeller systems, it is beneficial to make the counter-rotating propellers rotate at different speeds. Some of the advantages that result from having the two propellers rotate at different speeds relate to improvements in the acceleration, top speed, and performance capability of the drive system. In addition, the two propellers can be provided with different pitches for improved maneuverability during at low speed docking procedures when the two propellers are rotated at different speeds. There are various reasons for designing a marine propulsion system in this way, but known designs require a degree of complexity that tends to make the propulsion system too expensive or unreliable. It would therefore be significantly beneficial if a counter-rotating marine propulsion system could provide a way in which the two propellers can be rotated at different speeds without requiring the undue complexity previously known to those skilled in the art.

SUMMARY OF THE INVENTION

A marine drive made in accordance with the preferred embodiment of the present invention comprises an inner propeller shaft and an outer propeller shaft. The inner and outer propeller shafts are disposed in coaxial and concentric relation with each other about an axis of rotation. The drive of the present invention further comprises one or more driveshafts and one or more pinion gears attached to the one or more driveshafts. A first gear is attached to the inner propeller shaft and the pinion gear is engaged in meshing relation with a first plurality of gear teeth of the first gear to rotate the inner propeller shaft in a first rotational direction about the axis of rotation. The first plurality of gear teeth have a first effective diameter about the axis of rotation.

The marine drive of the present invention further comprises a second gear attached to the outer propeller shaft. The pinion gear is engaged in meshing relation with a second plurality of gear teeth of the second gear in order to rotate the outer propeller shaft in a second rotational direction about the axis of rotation. The second plurality of gear teeth have a second effective diameter about the axis of rotation. The first and second effective diameters can have different magnitudes, whereby the inner and outer shafts rotate at different speeds about the axis of rotation.

In one embodiment of the present invention, the first effective diameter is larger than the second effective diameter. A first propeller can be attached to the inner propeller shaft and a second propeller can be attached to the outer propeller shaft. The first plurality of gear teeth can be disposed on a first beveled axial surface of the first gear. The first beveled surface can be designed to face either radially inward or radially outward at a chosen angle relative to the axis of rotation. The second plurality of gear teeth can be disposed on a second beveled axial surface of the second gear and the second beveled surface can be designed to face either radially outward or radially inward at an angle with respect to the axis of rotation.

The pinion gear, which is attached to the driveshaft, can comprise a first set of gear teeth and a second set of gear teeth. The first set of gear teeth is disposed in meshing relation with the first plurality of teeth of the first gear and the second set of gear teeth are disposed in meshing relation with the second plurality of gear teeth of the second gear. In a preferred embodiment of the present invention, the driveshaft is disposed in a generally perpendicular association with the axis of rotation about which the inner and outer propeller shafts rotate. In one embodiment of the present invention, the first gear is a fore gear and the second gear is an aft gear. Also, the first propeller is an aft propeller and the second propeller is a fore propeller. However, it should be clearly understood that the basic principles of the present invention do not depend on these particular designations. In addition, although the preferred embodiment will be described below in relation to a single input shaft, it should be clearly understood that dual input shafts could be incorporated to accomplish the goals of the present invention.

BRIEF DESCRIPTION OF THE DRAWINGS

The present invention will be more fully and completely understood from the reading of the description of the preferred embodiment in conjunction with the drawings, in which.

DESCRIPTION OF THE PREFERRED EMBODIMENT

Figure 1:
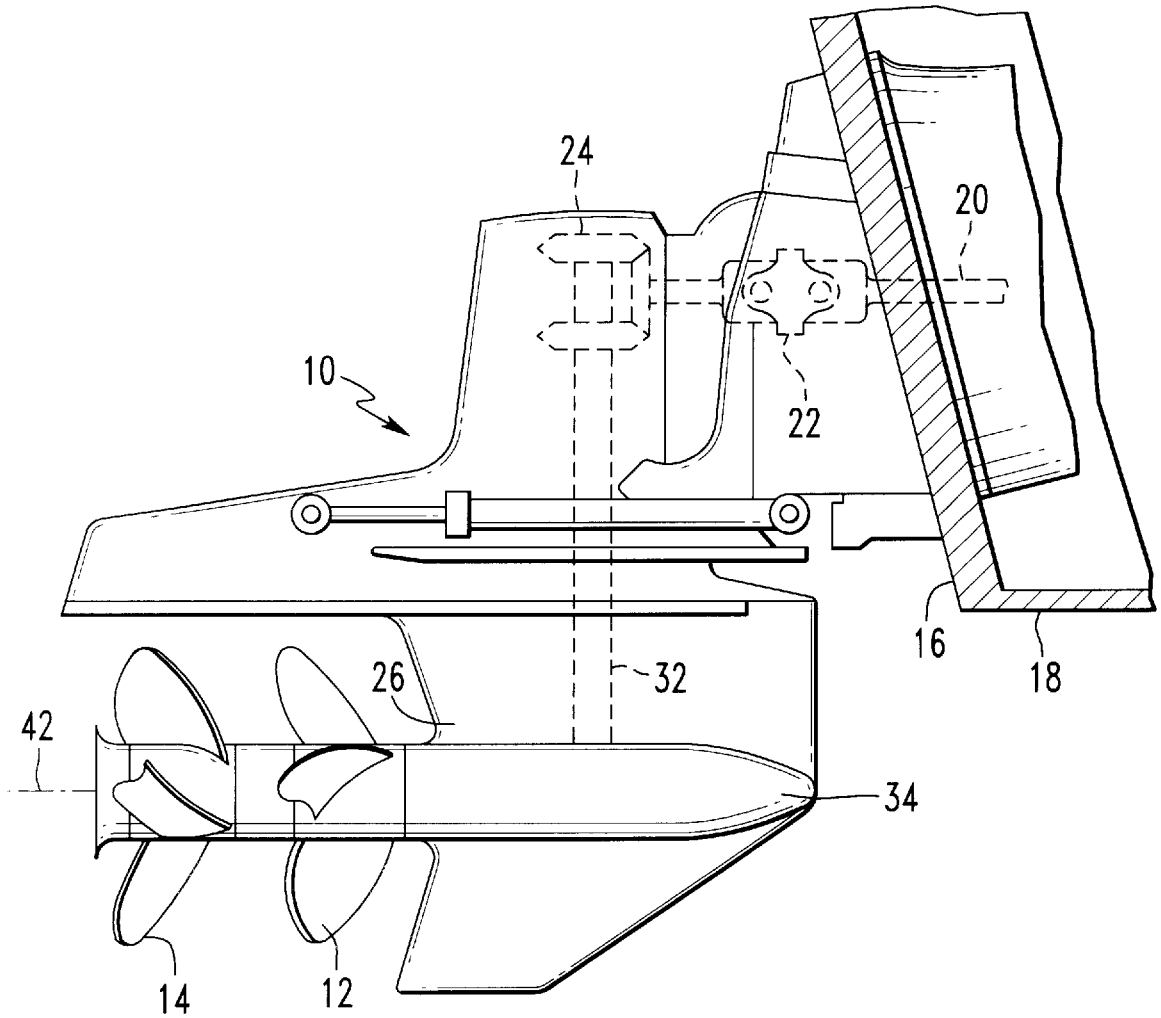
FIG. 1 PRIOR ART
FIG. 1 shows an exemplary dual propeller marine drive known to those skilled in the art.

Throughout the description of the preferred embodiment of the present invention, like components will be identified by like reference numerals.

FIG. 1 shows a propeller arrangement for a stem drive marine propulsion system known to those skilled in the art. A marine drive 10 has two counter-rotating propellers, 12 and 14. The drive is mounted to the transom 16 of a boat 18 in a manner generally known to those skilled in the art. An input shaft 20, shown by dashed lines in FIG. 1, is coupled through an universal joint 22 to an upper gear and clutch mechanism 24 which is generally known to those skilled in the art. The universal joint 22 allows trimming and steering of the drive. The drive housing 26 has a lower horizontal bore and an intersecting vertical bore contained therein. The upper gear mechanism 24 drives a vertical driveshaft 32 which will be described below in greater detail in relation to FIG. 3. A horizontal bore is disposed in the position of the drive housing referred to by those skilled in the art as the torpedo 34.

Figure 2:
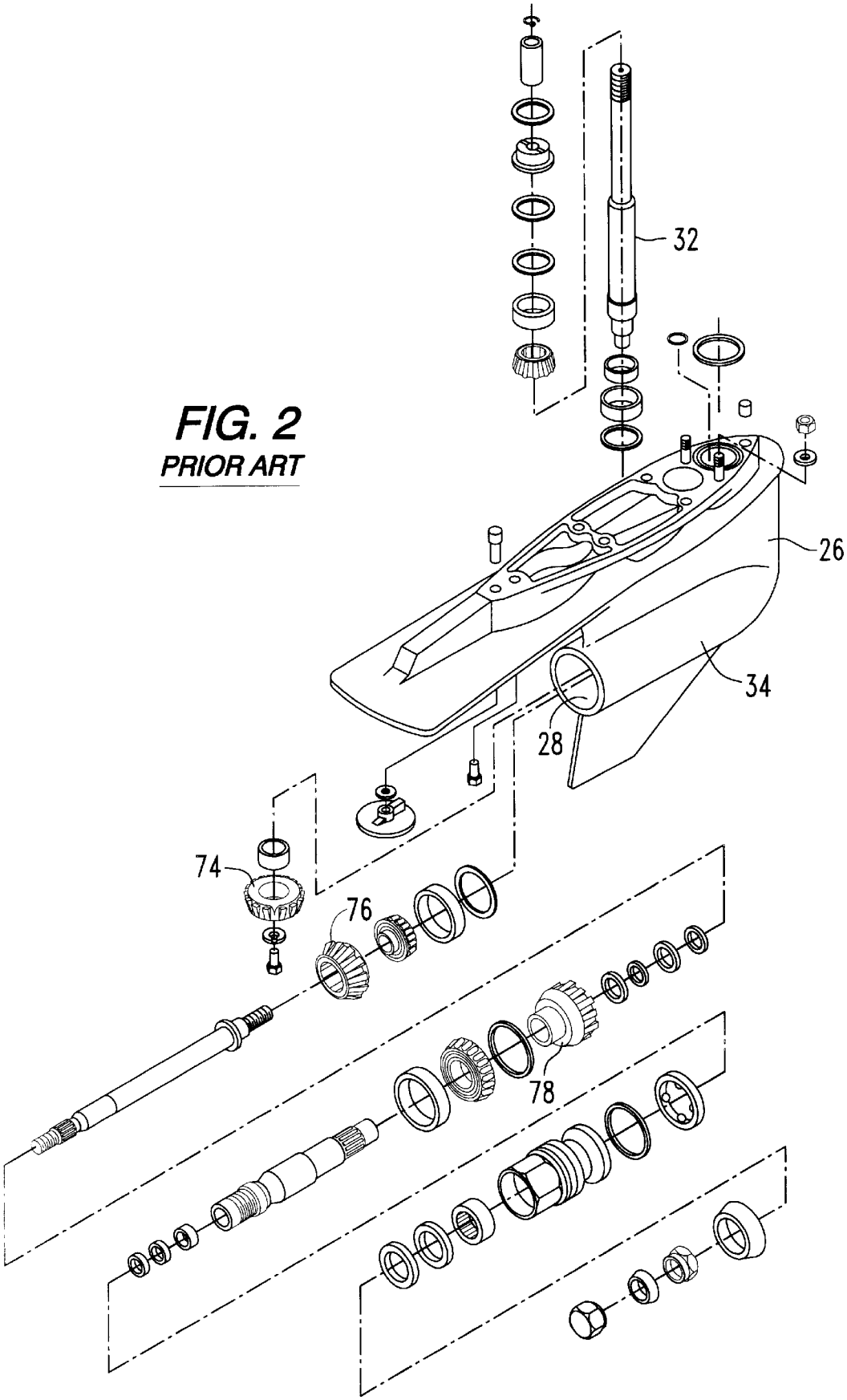
FIG. 2 PRIOR ART
FIG. 2 is an exploded view of a dual propeller marine drive gearcase assembly known to those skilled in the art.

FIG. 2 shows a gear housing which is well known to those skilled in the art. It is an exploded view of a twin propeller gear housing and the components contained therein. Many of the components shown in FIG. 2 are described in greater detail in U.S. Pat. No. 5,366,398, U.S. Pat. No. 5,249,995, U.S. Pat. No. 5,230,644, and U.S. Pat. No. 5,352,141 which are all explicitly incorporated by reference herein. Most of the components shown in FIG. 2 are not identified by reference numerals because they do not directly relate to the basic concept of the present invention. Rather, they are components which can be used in gear housings of twin propeller systems regardless of whether or not the gear sets are made in accordance with the present invention or in accordance with the concepts that are well known to those skilled in the art. The complete structure shown in FIG. 2 is identified, with all its constituent components, in significant detail in Quicksilver Parts Catalog for the BRAVO I/II/III stem drive and transom assembly. The Parts Catalog showing the constituent components illustrated in FIG. 2 is identified by number 90-809808-96 and was revised in Aug. 1996.

In order to more clearly understand the difference between the present invention and the prior art, it is important to observe in FIG. 2 the shapes and relative sizes of the fore gear 76, the aft gear 78 and the pinion gear 74. These components, which are identified by reference numeral in FIG. 2, are shaped and sized so that the fore and aft gears, 76 and 78, mesh with the pinion gear 74 in such a way that the inner and outer shafts, 40 and 38, are rotated at the same speed. This meshing relationship is better illustrated in FIG. 3.

Figure 3:
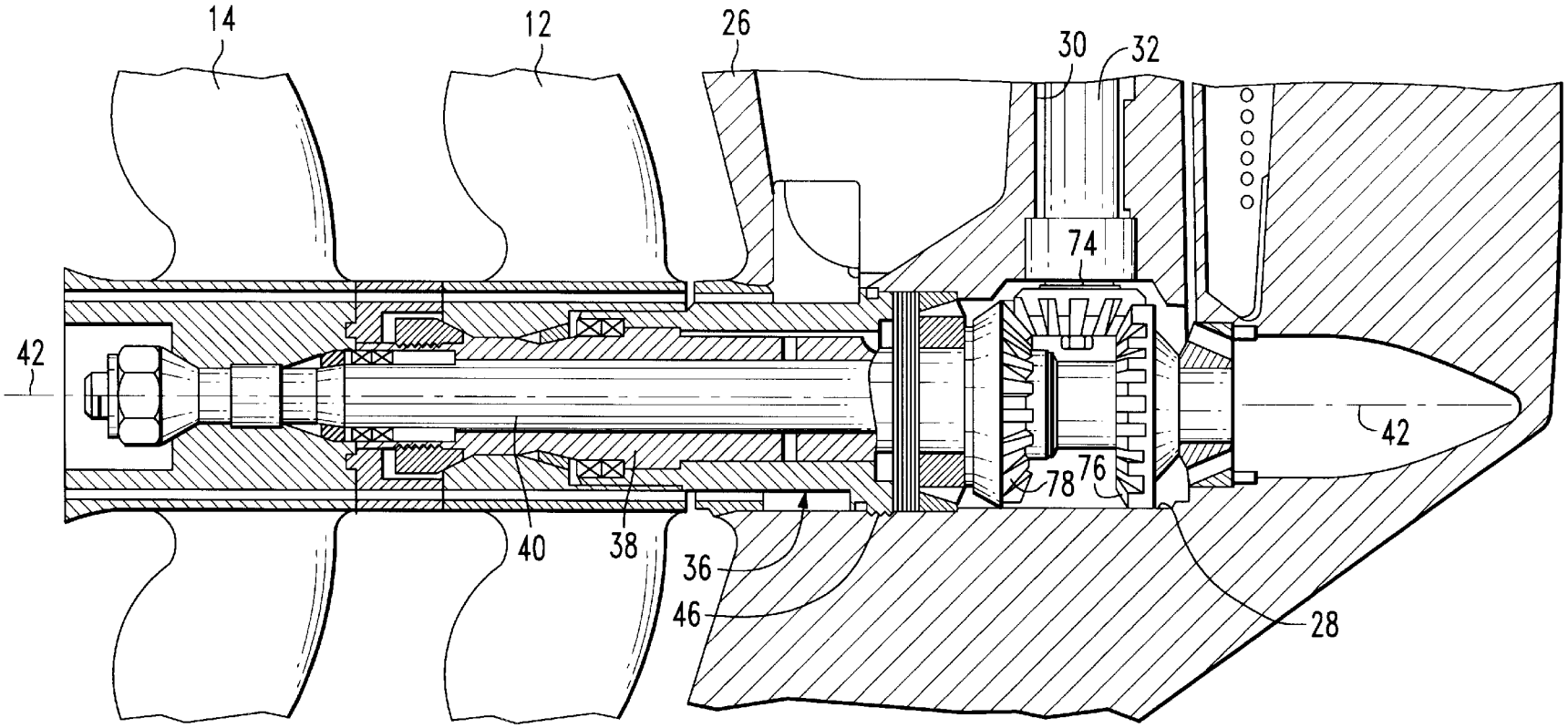
FIG. 3 PRIOR ART
FIG. 3 is a section view of a dual propeller marine drive lower gearcase assembly known to those skilled in the art with inner and outer counter-rotating shafts.

FIG. 3 is a sectional view of a marine drive system such as that illustrated in FIGS. 1 and 2. The vertical driveshaft 32 is positioned in the vertical bore 30. A horizontal bore 28 is located in the torpedo and arranged in generally perpendicular association with the vertical bore 30. A spool 36 is positioned in horizontal bore 28 and supports a dual propeller shaft assembly, including a hollow outer propeller shaft 38 positioned in the spool 36 and an inner propeller shaft 40 positioned in the outer propeller shaft 38. The inner and outer propeller shafts are concentric and rotate in opposite rotational directions along a axis of rotation 42. Spool 36 is a cylindrical member having a forward first outer diameter portion threadedly engaging housing 26 within horizontal bore 28 at thread set 46. The spool includes a second reduced outer diameter portion within the horizontal bore 28 and aft of the first outer diameter portion and defining an annular recess. Spool 36 includes a third outer diameter portion aft of the second outer diameter portion and engaging the drive housing 26 at the aft end of horizontal bore 28.

A pinion driving gear 74 is mounted on the lower end of vertical driveshaft 32 in a manner generally known to those skilled in the art. A first driven gear 76, or fore gear, is fixed on a inner propeller shaft 40 in spline relation and is engaged by the pinion gear 74. It drivingly rotates the inner propeller shaft 40 in a first rotational direction. A second driven gear 78, or aft gear, is fixed on the outer propeller shaft 3 8 in spline relation and is engaged by pinion gear 74 to drivingly rotate the outer propeller shaft 38 in a second opposite rotational direction, as is generally known to those skilled in the art.

The other components shown in FIG. 3 which are not described in detail herein are disclosed in U.S. Pat. No. 5,352,141 which is hereby incorporated by reference. The specific structure of the bearings, shafts, hubs and other components illustrated in FIG. 3 is not critically important to an understanding of the operation of the present invention. Instead, the primary importance of FIG. 3 is to show the general relationship between the fore gear 76, the aft gear 78 and the pinion gear 74. Furthermore, the relationship of the inner propeller shaft 40 with the outer propeller shaft 38 and their respective attachments to the fore gear 76 and aft gear 78, respectively, shows the general configuration and layout of a typical counter-rotating marine drive known to those skilled in the art. It is important to note that the interconnection shown in FIG. 3 results in the inner and outer propeller shafts rotating in opposite directions, but at the same speed. The purpose of the present invention is to provide a counterrotating marine drive in which the aft and fore propellers can be caused to rotate at different rotational speeds.

Figure 4:
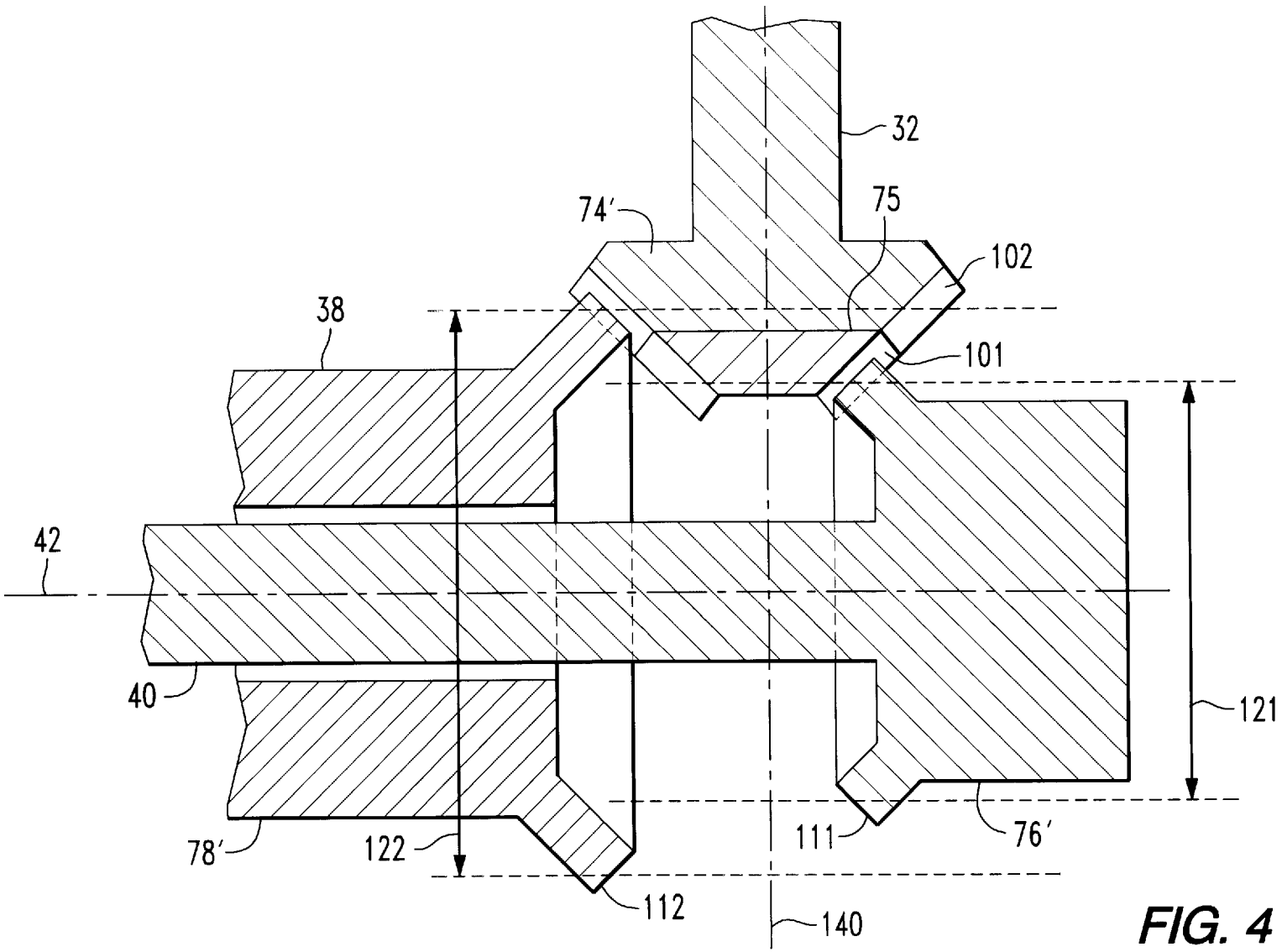
FIG. 4 is a section view of a marine drive made in accordance with the present invention.

In order to more clearly explain the basic structure of the present invention and show its method of operation, FIG. 4 represents the present invention in a simplified schematic drawing. Although FIG. 4 does not contain all of the bearing, attachment and support components shown in FIG. 3, it should be understood that, except for the aft gear, the fore gear and the pinion, the basic components shown in FIG. 3 would also be incorporated into a marine drive made in accordance with the present invention. Therefore, these portions of the marine drive are not shown in FIG. 4.

The pinion gear 74' in FIG. 4 is provided with a first set of gear teeth 101 and a second set of gear teeth 102. The fore gear 76' is provided with a beveled surface on which a first plurality of teeth 111 are disposed. The pinion gear 74' can comprise a single piece gear or a two piece gear. If the pinion gear 74' is a single piece gear, its teeth would extend along a conical region and define two different effective diameters identified by arrows 121 and 122. Alternatively, the pinion gear 74' can comprise two separate pinion structures attached together. The advantage of a split pinion structure is that the first set of gear teeth 101 and the second set of gear teeth 102 can be different in size and number and, as a result, the overall design is less restrictive in the selection of gear ratios than when a single pinion is used. Line 75 identifies the split line between the two pinion sections if the pinion 74' is a two piece structure. If a single piece pinion 74' is used, the number of teeth in the first and second gear tooth sets, 101 and 102, must be the same and this requirement restricts the overall design possibilities of the propulsion system.

The aft gear 78' comprises a second beveled surface on which a second plurality of teeth 112 is disposed. The first set of gear teeth 101 of the pinion gear 74' is disposed in meshing relation with the first plurality of gear teeth 111 of the fore gear 76'. The second set of gear teeth 102 of the pinion gear 74' are disposed in meshing relation with the second plurality of gear teeth 112 of the aft gear 78'.

In FIG. 4, the upper set of pinion gear teeth 102 mesh with the aft gear 78' while the lower set of pinion gear teeth 101 mesh with the fore gear 76'. The first beveled surface of the fore gear 76', on which the first plurality of gear teeth 111 is disposed, faces outwardly at an angle from the axis of rotation 42. The second beveled surface on which the second plurality of gear teeth 112 is disposed on the aft gear 78' also faces outwardly at an angle toward the axis of rotation 42. However, it should be understood that the directions in which these gear teeth face in FIG. 4 are not limiting. One skilled in the art can readily imagine how the pinion gear 74' could be designed and positioned to mesh with inwardly directed gear teeth of the first and second gears.

It is important to note that the first plurality of teeth 111 has a first effective diameter 121 as shown in FIG. 4. Similarly, the second plurality of gear teeth 112 has a second effective diameter 122. Because of the structure of the aft and fore gears, 78' and 76', and the pinion gear 74', the first and second effective diameters, 121 and 122, are unequal in magnitude. The second effective diameter 122 is larger than the first effective diameter 121. As a result, for each rotation of the driveshaft 32 about axis 140, the fore gear 76' will rotate more than the aft gear 78' which has a larger effective diameter 122. As a result, the inner propeller shaft 40 will rotate faster than the outer propeller shaft 38.

This differential speed between the inner and outer propeller shafts is achieved without the requirement of any additional components than those required in the prior art as described above in conjunction with FIG. 3. Instead, the achievement of differential rotational speeds for the aft and fore propellers is accomplished by modifying the characteristics of the pinion gear 74' and by changing the configuration of the fore and aft gears, 76' and 78' to incorporate different effective diameters. By changing the shapes of the fore gear, the aft gear and the pinion gear, the present invention is able to provide a marine drive system with counter-rotating propellers in which the propellers rotate at different speeds. Naturally, the difference in rotational speeds between the fore and aft propellers can be selected by selecting the fore and aft gears, 76' and 78', to have appropriate first and second effective diameters, respectively.

While the present invention has been illustrated to provide an inner propeller shaft 40 that rotates faster than the outer propeller shaft 32 and therefore an aft propeller 14 that rotates faster than the fore propeller 12, it should be understood that these functions could be reversed by simply designing the aft and fore gears, 76' and 78', in a reverse manner so that the first effective diameter 121 is larger than the second effective diameter 122. The magnitude of difference between the first and second effective diameters will determine the ratio of speeds for the fore and aft propellers, 12 and 14.

Although the present invention has been described in terms that identify the pinion gear 74 as a single gear with two rows of gear teeth (commonly referred to as a "bull" gear) formed in it, it should be understood that similar results could be obtained by alternatively attaching two pinion gears on the shaft 32 in close proximity to each other. In FIG. 4, this concept is illustrated by line 75 which shows a split line where two pinion gears would be attached together. If two pinion gears are used, the numbers of teeth of the two pinions could be different, thus allowing a wider selection of gear ratios for the propulsion system. In other words, the pinion gear 74 would be a split pinion with the two portions of the pinion gear being axially spaced from each other along the axis of the shaft 32. One of the pinion gears would mesh with the fore gear 76 and the other would mesh with the aft gear 78. The fore and aft gears, as described above, would be provided with different effective diameters to achieve the different rotational speeds for the fore and aft propellers. Using a single pinion gear 74, as described above and illustrated in FIG. 4, is the preferred embodiment of the present invention, but alternative embodiments could use two-piece pinion gears.

The illustrations in FIGS. 1, 2 and 3 illustrate a propulsion system in which the propellers, 12 and 14, provide a force that pushes against the housing. This force is transmitted to the boat and provides its propulsion. However, it should be clearly understood that the basic concepts of the present invention are equally applicable to a tractor system that exerts a force that pulls on the propeller shaft and the housing. In other words, the basic concepts of the present invention are not limited to details relating to the ratio of speeds of the propellers, their pitches or arrangement, or whether they push or pull against the associated housing.

As can be seen from the above description, the present invention provides a dual propeller marine system to have counter-rotating propellers that rotate at different speeds. In addition, this feature is provided without an increase in the number of components required for the marine drive system. Although the present invention has been described to particularly illustrate a certain embodiment, it should be understood that alternative embodiments are also within its scope.

We claim:

1. A marine drive comprising:

an inner propeller shaft;

an outer propeller shaft, said inner and outer propeller shafts being disposed in coaxial and concentric relation with each other about an axis of rotation;

a driveshaft;

a pinion gear attached to said drive shaft;

a first gear attached to said inner propeller shaft, said pinion gear being engaged in meshing relation with a first plurality of gear teeth of said first gear to rotate said inner propeller shaft in a first rotational direction about said axis of rotation, said first plurality of gear teeth having a first effective diameter about said axis of rotation; and a second gear attached to said outer propeller shaft, said pinion gear being engaged in meshing relation with a second plurality of gear teeth of said second gear to rotate said outer propeller shaft in a second rotational direction about said axis of rotation, said second plurality of gear teeth having a second effective diameter about said axis of rotation, said first and second effective diameters having different magnitudes, whereby said inner and outer shafts rotate at different speeds about said axis of rotation.

2. The marine drive of claim 1, wherein:

said first effective diameter is larger than said second effective diameter.

3. The marine drive of claim 1, further comprising:

an aft propeller attached to said inner propeller shaft; and a fore propeller attached to said outer propeller shaft.

4. The marine drive of claim 1, wherein:

said first plurality of gear teeth being disposed on a first beveled axial surface of said first gear.

5. The marine drive of claim 4, wherein:

said first beveled surface faces radially inward at an angle toward said axis or rotation.

6. The marine drive of claim 4, wherein:

said first beveled surface faces radially outward at an angle from said axis or rotation.

7. The marine drive of claim 1, wherein:

said second plurality of gear teeth being disposed on a second beveled axial surface of said second gear.

8. The marine drive of claim 6, wherein:

said second beveled surface faces radially outward at an angle from said axis or rotation.

9. The marine drive of claim 6, wherein:

said second beveled surface faces radially inward at an angle toward said axis or rotation.

10. The marine drive of claim 1, wherein:

said pinion gear comprises a first set of gear teeth and a second set of gear teeth, said first set of gear teeth being disposed in meshing relation with said first plurality of gear teeth of said first gear, said second set of gear teeth being disposed in meshing relation with said second plurality of gear teeth of said second gear.

11. The marine drive of claim 1, wherein:

said driveshaft is generally perpendicular to said axis of rotation.

12. A marine drive comprising:

an inner propeller shaft;

an outer propeller shaft, said inner and outer propeller shafts being disposed in coaxial and concentric relation with each other about an axis of rotation;

a driveshaft;

a pinion gear attached to said drive shaft;

a fore gear attached to said inner propeller shaft, said pinion gear being engaged in meshing relation with a first plurality of gear teeth of said fore gear to rotate said inner propeller shaft in a first rotational direction about said axis of rotation, said first plurality of gear teeth having a first effective diameter about said axis of rotation;

an aft gear attached to said outer propeller shaft, said pinion gear being engaged in meshing relation with a second plurality of gear teeth of said aft gear to rotate said outer propeller shaft in a second rotational direction about said axis of rotation, said second plurality of gear teeth having a second effective diameter about said axis of rotation, said first effective diameter being larger than said second effective diameter, whereby said inner and outer shafts rotate at different speeds about said axis of rotation;

an aft propeller attached to said inner propeller shaft; and a fore propeller attached to said outer propeller shaft.

13. The marine drive of claim 12, wherein:

said first plurality of gear teeth is disposed on a first beveled axial surface of said fore gear, said first beveled surface facing radially inward at an angle toward said axis or rotation.

14. The marine drive of claim 12, wherein:

said second plurality of gear teeth is disposed on a second beveled axial surface of said aft gear, said second beveled surface facing radially outward at an angle from said axis or rotation.

15. The marine drive of claim 12, wherein:

said pinion gear comprises a first set of gear teeth and a second set of gear teeth, said first set of gear teeth being disposed in meshing relation with said first plurality of gear teeth of said fore gear, said second set of gear teeth being disposed in meshing relation with said second plurality of gear teeth of said aft gear.

16. The marine drive of claim 12, wherein:

said driveshaft is generally perpendicular to said axis of rotation.

17. A marine drive comprising:

an inner propeller shaft;

an outer propeller shaft, said inner and outer propeller shafts being disposed in coaxial and concentric relation with each other about an axis of rotation;

a driveshaft disposed generally perpendicular to said axis of rotation;

a pinion gear attached to said drive shaft;

a fore gear attached to said inner propeller shaft, said pinion gear being engaged in meshing relation with a first plurality of gear teeth of said fore gear to rotate said inner propeller shaft in a first rotational direction about said axis of rotation, said first plurality of gear teeth having a first effective diameter about said axis of rotation;

an aft gear attached to said outer propeller shaft, said pinion gear being engaged in meshing relation with a second plurality of gear teeth of said aft gear to rotate said outer propeller shaft in a second rotational direction about said axis of rotation, said second plurality of gear teeth having a second effective diameter about said axis of rotation, said first effective diameter being larger than said second effective diameter, whereby said inner and outer shafts rotate at different speeds about said axis of rotation;

an aft propeller attached to said inner propeller shaft; and a fore propeller attached to said outer propeller shaft.

18. The marine drive of claim 17, wherein:

said first plurality of gear teeth is disposed on a first beveled axial surface of said fore gear, said first beveled surface facing radially inward at an angle toward said axis or rotation.

19. The marine drive of claim 17, wherein:

said second plurality of gear teeth is disposed on a second beveled axial surface of said aft gear, said second beveled surface facing radially outward at an angle from said axis or rotation.

20. The marine drive of claim 17, wherein:

said pinion gear comprises a first set of gear teeth and a second set of gear teeth, said first set of gear teeth being disposed in meshing relation with said first plurality of gear teeth of said fore gear, said second set of gear teeth being disposed in meshing relation with said second plurality of gear teeth of said aft gear.

* * * * *